US006520625B1

(12) United States Patent
Kawakami

(10) Patent No.: US 6,520,625 B1
(45) Date of Patent: Feb. 18, 2003

(54) CARRIAGE AND RECORDING APPARATUS

(75) Inventor: Hideaki Kawakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 09/640,060

(22) Filed: Aug. 17, 2000

(30) Foreign Application Priority Data

Aug. 20, 1999 (JP) ..... 11-234429

(51) Int. Cl.[7] ..... B41J 2/01
(52) U.S. Cl. ..... 347/49; 347/50
(58) Field of Search ..... 347/37, 49, 50

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/20 |
| 4,459,600 A | | 7/1984 | Sato et al. | 347/47 |
| 4,463,359 A | | 7/1984 | Ayata et al. | 347/47 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,757,403 A | | 5/1998 | Nagashima | 347/50 |
| 5,867,188 A | * | 2/1999 | Murayama et al. | 347/37 |
| 5,971,525 A | | 10/1999 | Inoue et al. | 347/50 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Anh T.N. Vo
(74) *Attorney, Agent, or Firm*—Fitzpatrick, Cella, Harper & Scitno

(57) ABSTRACT

The invention provides a carriage for a recording apparatus, comprising a head mounting portion on which a head cartridge is detachably mounted, a connector portion to be electrically connected with the head cartridge, an operating portion for rendering the head cartridge attachable to or detachable from the head mounting portion, wherein when rotated in a first direction, the operating portion fixes the head cartridge mounted on the head mounting portion and electrically connects the connector portion, while when rotated in a second direction opposite to that in the fixing operation, the operating portion releases the electrical connection between the head cartridge and the connector portion, and a connector protecting member adapted to protect the connector portion and being linked with the rotation of the operating portion. When the operating portion is rotated in a direction rendering the head cartridge detachable or mountable, the connector portion moves to a position protecting the connector portion, while when the operating portion is rotated in a direction fixing the head cartridge, the connector portion moves to a position exposing the connector portion.

24 Claims, 14 Drawing Sheets

CARRIAGE AND RECORDING APPARATUS

BACKGROUND OF THE INVENTION

1. Field of the Invention

The present invention relates to a recording apparatus having a detachable head cartridge, and more particularly to an attaching/detaching mechanism of the head cartridge.

2. Related Background Art

A recording apparatus for recording on a recording medium (hereinafter also called recording sheet) such as paper, cloth, plastic sheet or OHP sheet has been proposed in a form capable of mounting a head cartridge of various recording systems, such as wire dot system, thermosensitive system, thermal transfer system or ink jet system.

Among these recording apparatuses, an apparatus that is equipped with a head cartridge of ink jet type, which performs non-impact recording at a low noise level, forms a record on a recording sheet by discharging ink from a discharge port (nozzle) arranged on a recording element (hereinafter also called an ink jet recording apparatus), and is capable of high-density and high-speed recording.

The ink jet recording apparatus assumes a configuration matching the function, specification, form, etc. peculiar to a system to which the apparatus is applied. In general, the ink jet recording apparatus is provided with a carriage supporting a head cartridge and an ink tank, conveying means for conveying the recording sheet, and control means for controlling these components.

Also the head cartridge for discharging ink droplets from plural discharge ports is driven in a serial scanning motion in a direction (main scanning direction) perpendicular to the conveying direction (sub scanning direction) of the recording sheet, while the recording sheet is intermittently conveyed (pitch conveying) by an amount equal to the recording width. By employing a head cartridge having plural ink discharging nozzles arranged linearly in the sub scanning direction, there is achieved recording of a width corresponding to the number of nozzles by a single scan of the head cartridge on the recording sheet.

Also the ink jet recording apparatus has a low running cost, can be made compact in its dimensions and can achieve color image recording by employing inks of plural colors.

For these reasons, the ink jet recording apparatus is utilized and commercialized as the output means of information processing systems, for example, a printer constituting an output terminal of a copying machine, a facsimile apparatus, an electronic typewriter, a word processor, a work station, etc., or a handy or portable printer equipped in a personal computer, a host computer, an optical disk device, a video apparatus, etc.

As the recording element of such ink jet recording means, namely the energy generating means for generating energy for discharging ink, there have been known, for example, an electromechanical converting member such as a piezo element, utilization of heat generated by irradiation with an electromagnetic wave such as a laser beam to discharging liquid droplet, or heating of liquid by an electrothermal converting element having a heat generating resistance member.

Among these systems, the head cartridge of the ink jet recording system for discharging liquid by thermal energy is capable of recording with high resolution because the aforementioned discharge ports can be arranged at a high density. In particular, the head cartridge utilizing the electrothermal converting element as the energy generating means is advantageous since it can easily be made compact, it can fully utilize semiconductor technology and microprocessing technology which have recently shown remarkable progress and improvement in reliability, and it can achieve a high density with a low manufacturing cost.

Also the ink tank for supplying the head cartridge with ink is basically composed of an ink absorbent member, a container for holding the ink absorbent member, and a cover member for sealing the container.

Also the aforementioned head cartridge can be realized in a chip type integrated with such ink tank, or in a type detachably combined with the ink tank. In either type, the positioning between the recording head and the ink tank, and the positioning between the head cartridge formed by integrating these members and the carriage are important items relating to the recording quality.

Recently there is also proposed a recording apparatus in which plural head cartridges of different external shapes can be detachably attached for replacement onto the carriage. More specifically, a color head is mounted on the carriage for recording color graphics. The color head is composed of plural tanks, respectively containing inks of black, yellow, magenta and cyan colors, detachably mounted on a head. Also a photo head is mounted on the carriage for photographic tone recording. The photo head is composed of plural tanks, respectively containing inks of pale black, yellow, pale magenta and pale cyan colors, detachably mounted on a head. Also in case of recording a text with black color, a black head having a tank of black color only is mounted on the carriage.

The color head, the photo head and the black head are the same in the mechanism for attaching to the carriage and in the shape, but the black head has a smaller width in comparison with the color head or the photo head, because of the lower ink capacity in the tank.

The black head, having a smaller width than in the color head or the photo head, is smaller in width than the carriage. For this reason it can be mounted in an inclined position on the carriage, and the connector portion of the carriage may be smeared by the ink of the nozzle portion of the black head. The ink deposition on the connector portion of the carriage may result in shortcircuiting, leading to drawbacks such as defective recording or malfunction of the recording apparatus.

SUMMARY OF THE INVENTION

An object of the present invention is to provide a head cartridge attach/detaching mechanism capable, in mounting a head cartridge of a smaller size with respect to the carriage, of avoiding contact of the recording portion of the head cartridge with the connector portion of the carriage, and also ensuring satisfactory operability.

Another object of the present invention is to provide a carriage of a recording apparatus, comprising a head mounting portion on which the head cartridge is detachably mounted, a connector portion to be electrically connected with the head cartridge, an operating portion adapted, when rotated in a direction, to fix the head cartridge mounted on the head mounting portion and to electrically connect the connector portion while, when rotated in a direction opposite to that in the fixing operation, to release the electrical connection between the head cartridge and the connector portion thereby rendering the head cartridge detachable from or mountable to the head mounting portion, and a connector protecting member adapted to protect the connector portion and, when the operating portion is rotated in a direction rendering the head cartridge detachable or mountable, to move to a position protecting the connector portion, while, when the operating portion is rotated in a direction fixing the head cartridge, to move to a position exposing the connector portion.

DETAILED DESCRIPTION OF THE PREFERRED EMBODIMENTS

Now the present invention will be clarified in detail by preferred embodiments thereof with reference to the accompanying drawings.

[First Embodiment]

At first the configuration of the recording apparatus of the present invention will be schematically explained with reference to FIGS. 1 and 2, which are respectively a perspective view and a plan view showing the entire configuration of a recording apparatus constituting a first embodiment of the present invention.

Figure 1:
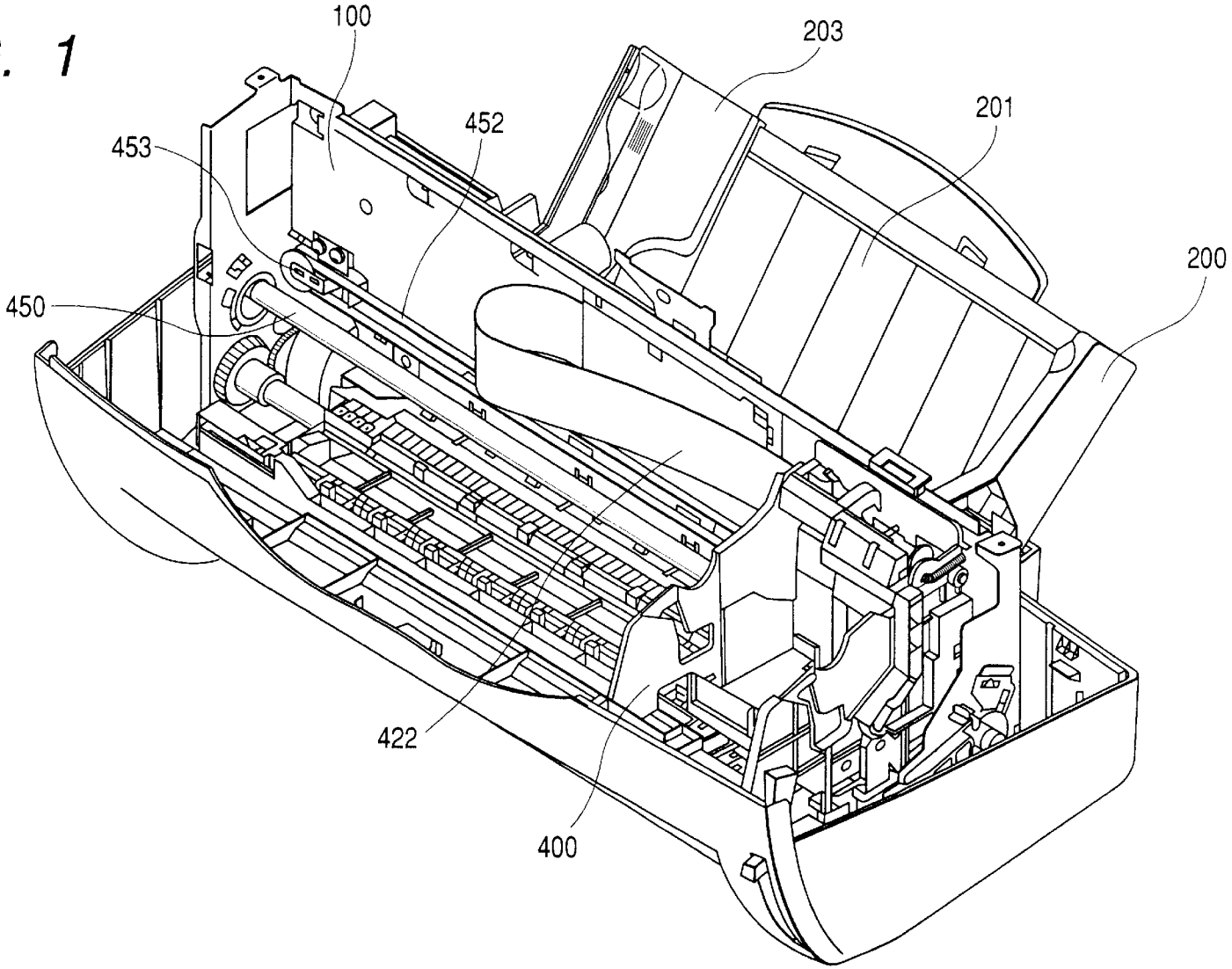
FIG. 1 is a perspective view showing the entire configuration of an ink jet recording apparatus constituting a first embodiment of the present invention.
Figure 2:
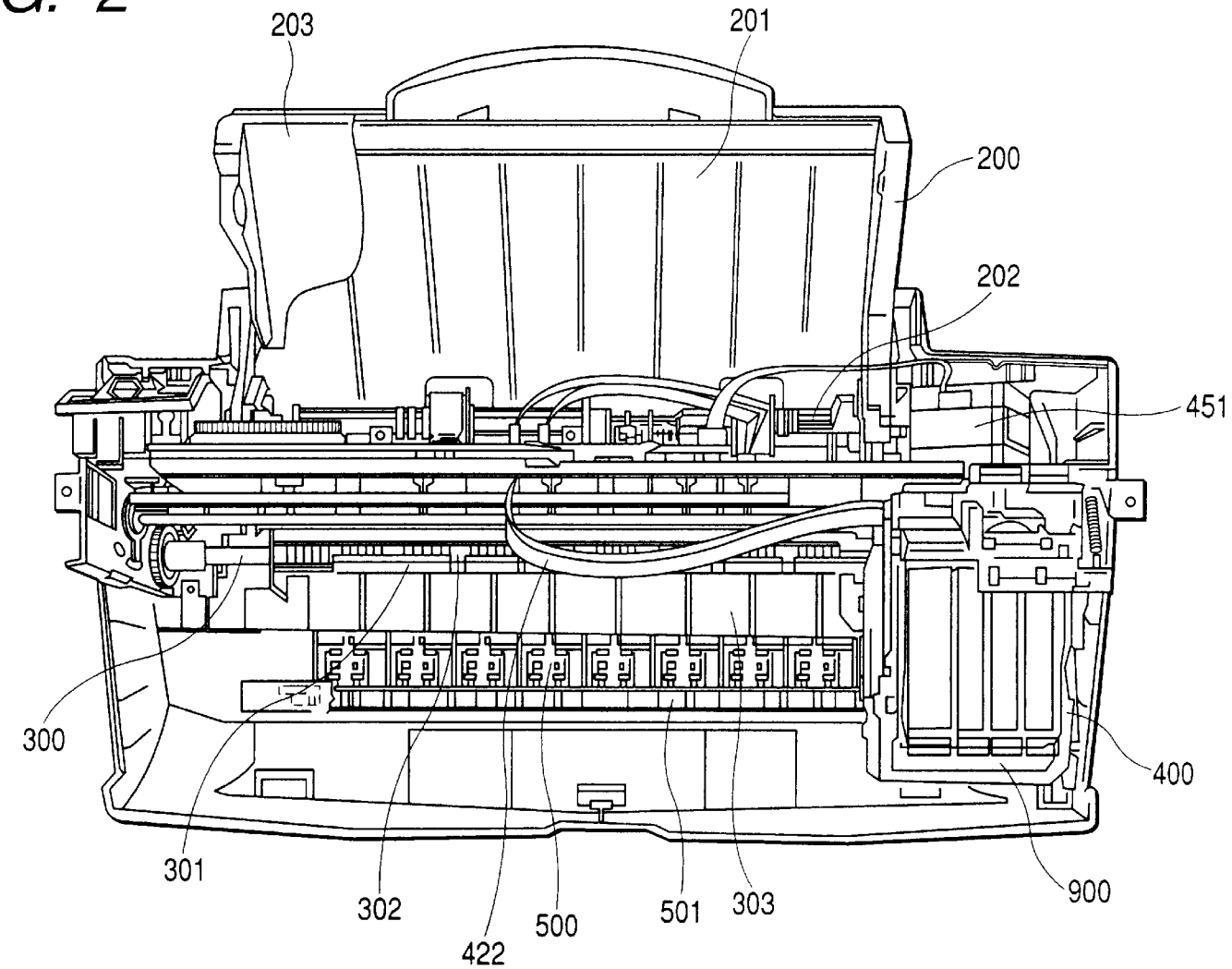
FIG. 2 is a plan view showing the entire configuration of an ink jet recording apparatus constituting the first embodiment of the present invention.

The recording apparatus, having an automatic sheet feeding device as shown in FIGS. 1 and 2, is composed of a sheet feeding unit, a sheet conveying unit, a carriage unit, a sheet discharge unit and a cleaning unit. These components will be individually explained in the following.

(A) Sheet Feeding Unit

The sheet feeding unit is composed of a pressing plate 201 for stacking sheet materials (not shown) and a rotary feeding member 202 for feeding the sheet material, both being mounted to a base member 200. On the pressing plate 201, a moveable side guide 203 is movably mounted to limit the stacking position of the sheet materials. The pressing plate 201 is rotatable about a rotating shaft coupled to the base member 200, and is biased toward the rotary feeding member 202 by a pressing plate spring (not shown). On a position of the pressing plate 201 opposed to the rotary feeding member 202 there is provided a separating pad 204, composed of a material of a large friction coefficient such as artificial leather, for preventing double feeding of the sheet materials. The base member 200 is further provided with a separating finger (not shown) covering a comer of the sheet materials thereby, separating the sheet materials one by one, a bank portion (not shown) formed integrally with the base member 200 and serving to separate cardboard or the like when the separating finger is automatically retracted, for example, by the cardboard, and a release cam (not shown) for releasing the contact between the pressing plate 201 and the rotary feeding member 202.

In the above-described configuration, the release cam presses down the pressing plate 201 to a predetermined position in a waiting state, whereby the pressing plate 201 is released from the contact with the rotary feeding member 202. When the driving force of a conveying roller 300 is transmitted in this state, for example, through gears, to the rotary feeding member 202 and the release cam, the release cam is separated from the pressing plate 201 to cause the elevation thereof, whereby the rotary feeding member 202 comes into contact with the sheet materials to start the sheet feeding. Thus the sheet is picked up by the rotation of the rotary feeding member 202, separated one by one by the separating finger and is fed to the sheet conveying unit. The rotary feeding member 202 and the release cam rotate until a sheet is fed into the sheet conveying unit, whereupon there is assumed again the waiting state in which the rotary feeding member 202 is released from the contact with the sheet materials and the driving force from the conveying roller 300 is interrupted.

(B) Sheet Conveying Unit

The sheet conveying unit is provided with the conveying roller 300 and a PE sensor (not shown). The conveying roller 300 is maintained in contact with a pinch roller 301, which is supported by a pinch roller guide 302 and is biased by a pinch roller spring (not shown) in contact with the conveying roller 300 thereby generating a conveying force for the sheet material. At the entrance of the sheet conveying unit for receiving the fed sheet, there are provided the pinch roller guide 302 and a platen 303 for guiding the sheet material. The pinch roller guide 302 is provided with a PE sensor lever (not shown) for transmitting the detection of the leading and trailing ends of the sheet to the PE sensor (not shown). Also in the downstream side of the conveying roller 300 in the conveying direction of the recording sheet, there is provided a head cartridge 900 for forming an image according to the image information.

In the above-described configuration, the sheet fed to the sheet conveying unit is guided by the platen 303 and the pinch roller guide 302 and supplied to the pair of the conveying roller 300 and the pinch roller 301. In this operation, the PE sensor lever detects the leading end of the conveyed sheet, thereby determining the recording position on the sheet. The sheet is conveyed onto the platen 303 by the rotation of the paired rollers 300, 301 by an unrepresented LF motor.

The head cartridge 900 is composed of an easily replaceable inkjet cartridge integrally containing an ink tank. In the head cartridge 900, the ink can be given heat by a heater, for example, whereby the ink causes film boiling and a pressure change induced by the growth or contraction of a bubble generated by such film boiling causes a nozzle of the head cartridge 900 to discharge ink, thereby forming an image on the sheet material.

(C) Carriage Unit

The carriage unit is provided with a head cartridge (a cartridge unit or a head holder) 900 constituting recording means composed of a recording head and a detachably mounted ink tank, and a carriage 400 detachably supporting the head cartridge 900.

Figure 6:
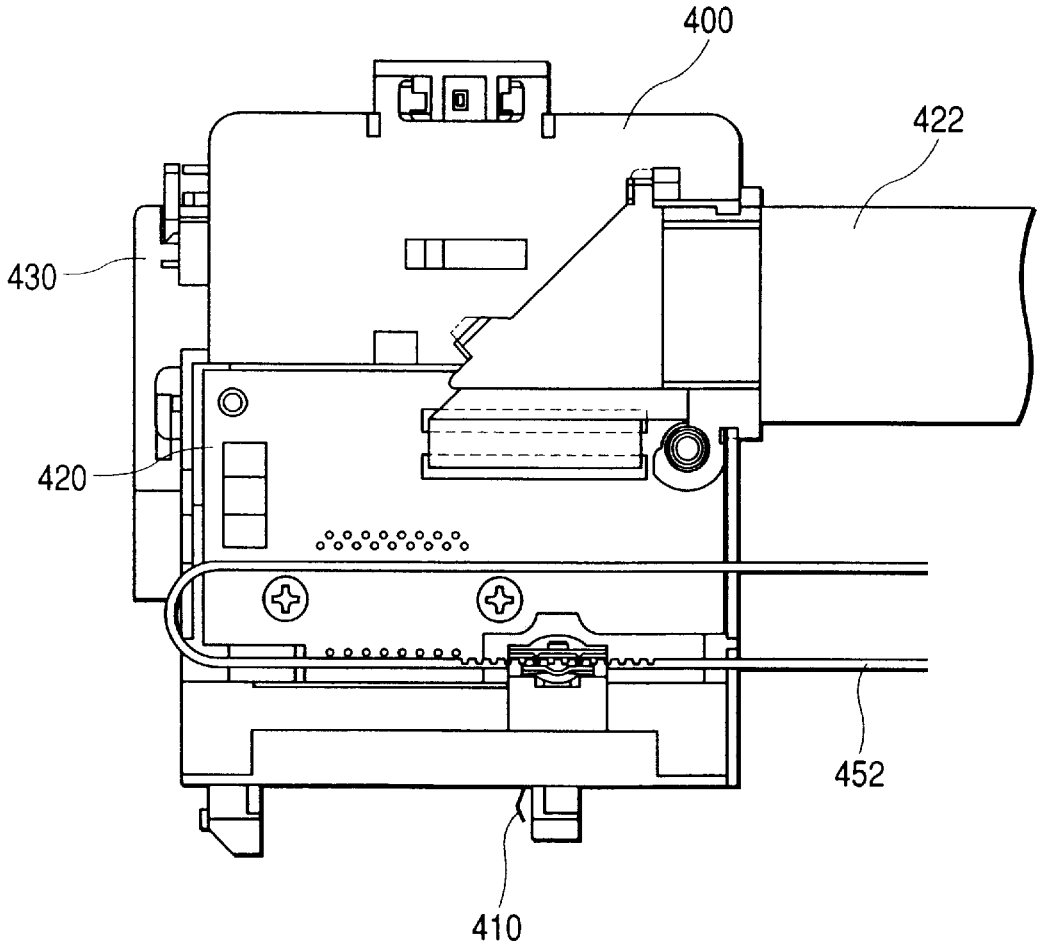
FIG. 6 is a rear view of the carriage shown in FIG. 1.

The carriage 400 is supported by a guide shaft 450, extending in a direction crossing the conveying direction of the sheet material, and a chassis 100. The guide shaft 450 is vertically elevated or lowered by the operation of a sheet gap adjusting lever (not shown) to maintain a gap between the head cartridge 900 and the sheet. The chassis 100 supports the rear end of the carriage 400, thereby maintaining the carriage 400 in a predetermined position with respect to the sheet material. The carriage 400 executes a reciprocating motion along the guide shaft 450 and the chassis 100, by the driving force transmitted from a carriage motor 451 through a timing belt 452. The timing belt 452 is supported under a tension by an idling pulley 453, while the guide shaft 450 and the carriage motor 451 are mounted on the chassis 100. On the rear face of the carriage 400 there is fixed a carriage circuit board 420 (cf. FIG. 6), and a flexible cable 422 is connected thereto for transmitting electrical signals from a circuit board (not shown), fixed on the rear face of the chassis 100, to the head cartridge 900.

In the present embodiment, the sheet material is conveyed by the conveying roller 300 and the pinch roller 301 in such a manner that the head cartridge 900 is opposed to a row position (a position of the sheet in the conveying direction thereof) where the image formation is to be executed on the sheet. The carriage 400 is moved by the driving force of the carriage motor 451 to a column position for image formation (a position perpendicular to the conveying direction of the sheet), whereby the recording head of the head cartridge 900 is opposed to the image forming position. Then, in response to the electrical signal from the aforementioned circuit boards, the head cartridge 900 discharges ink toward the sheet material to form the image thereon.

Figure 3A:
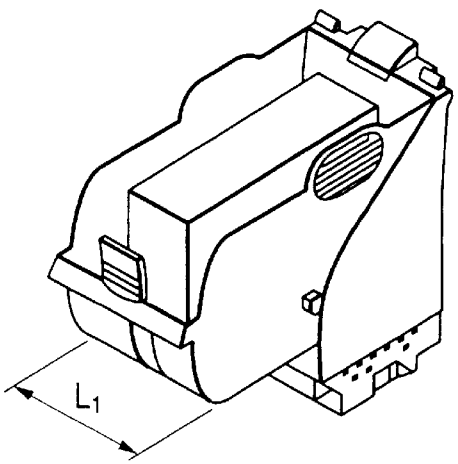
FIGS. 3A, 3B and 3C are perspective views showing different kinds of the head cartridge to be mounted on the ink jet recording apparatus shown in FIG. 1.
Figure 3B:
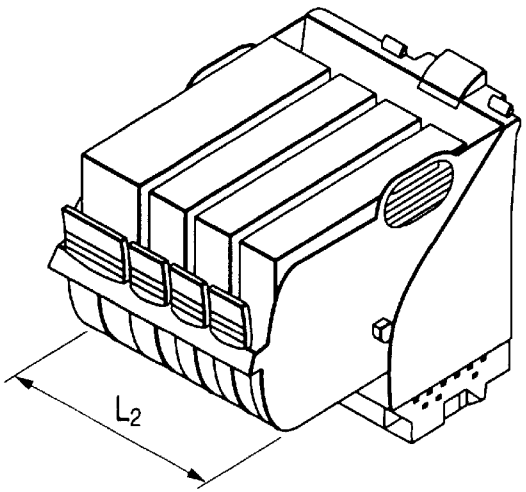
Figure 3C:
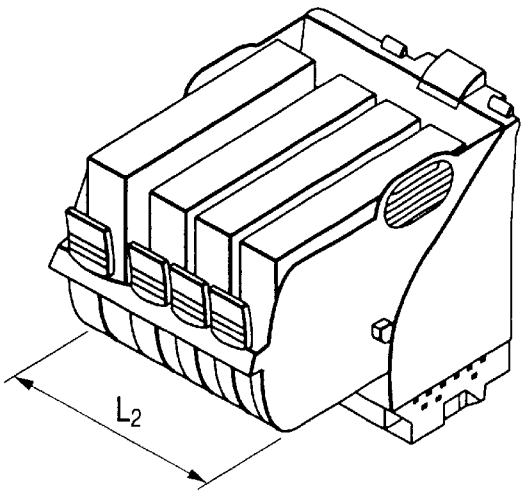

In the following there will be explained the head cartridge 900 with reference to FIGS. 3A, 3B and 3C which respectively show a black head, a color head and a photo head. The user executes recording by mounting, on the carriage 400, a head cartridge optimum for the record to be formed.

The head cartridge 900 is composed of a recording head and an ink tank detachably mounted thereto. The ink tank is principally composed of an ink absorbent member, a transparent plastic container in which the ink absorbent member is inserted, and a cover member for sealing the container. The width L1 of the black head is smaller than that L2 of the color head or the photo head.

The black head is provided with an ink tank containing black ink. The color head is provided with four detachable ink tanks, respectively containing yellow, magenta, cyan and black inks in succession from the right-hand side in the drawing. The photo head is provided with four detachable ink tanks, respectively containing yellow, pale photo magenta, pale photo cyan and pale photo black inks in succession from the right-hand side in the drawing. The ink tanks for the yellow, magenta, cyan, photo magenta, photo cyan and photo black colors have a same external shape. The black ink tank has a larger external shape and a larger ink amount in comparison with other ink tanks. The head cartridge, when seen from the rear side, is provided with holes in positions corresponding to the respective ink tanks of the recording head, so that the ink tanks are visible.

In the ink jet recording apparatus, the energy generation means (recording element) for generating energy for discharging the ink from the nozzle is conventionally composed of an electromechanical converting member such as a piezo element for pressurizing the ink, or an element for irradiation with electromagnetic waves such as a laser beam or an electrothermal converting element such as a heat-generating resistance member, for heating the ink to induce expansion or boiling thereof. The ink jet recording head of the latter system, utilizing thermal energy for liquid discharge, is capable of recording in a high resolution because the nozzles can be arranged in a high density. Among such systems, the recording head utilizing the electrothermal converting element as the energy generation means has various advantages, such as easily being made compact, fully utilizing semiconductor technology and micro process technology which have remarkably progressed and improved in reliability, and being easily produced with a high density and with a low manufacturing cost. Therefore, in the recording head of the head cartridge of the present embodiment there is employed a system of applying heat to the ink by an electrothermal converting element including a heat-generating resistance member such as a heater. The ink causes film boiling by such heat, and the pressure change induced by the growth or contraction of the bubble generated by the film boiling causes the ink to be discharged from the nozzle of the recording head, thereby forming an images.

(D) Sheet Discharge Unit

The sheet discharge unit is provided with a sheet discharge roller (upstream side) (not shown) and a sheet discharge roller (downstream side) (not shown), receiving the driving force from an LF gear provided coaxially with the conveying roller 300 through a train of gears. Spur wheels 500 rotated by the sheet discharge rollers are maintained in contact therewith, and are supported by a spur holder 501 which is fixed to the platen 303. Thus the sheet, subjected to image formation by the carriage unit, is pinched and conveyed between the sheet discharge rollers and the spur wheels and is discharged to a discharge tray (not shown).

(E) Cleaning Unit

The cleaning unit is provided with a pump for leaning the head cartridge 900, and a cap for preventing the head cartridge 900 from drying. There is also provided a mechanism for switching the driving force from the conveying roller 300 to the sheet feeding unit or to the pump. When the carriage is moved to the right-end position, the driving force of the LF motor is transmitted to the pump thereby executing cleaning of the head cartridge 900.

In the following there will be detailedly explained the principal parts of the carriage unit.

The carriage unit is formed by mounting various components to the carriage 400. FIGS. 4, 5, 6 and 7 are respectively a front view, a plan view, a rear view and a right-side view of the carriage unit, while FIG. 8 is a perspective view of a head cartridge to be mounted on the aforementioned carriage.

The carriage 400 is provided with a pocket (head mounting portion) for mounting the head cartridge 900. On both sides of the pocket, two grooves are formed for positioning the head cartridge 900. The pocket is provided with a plate spring 410 for biasing the head cartridge 900 in the x-direction. Also on the upper part of the carriage 400 a rotatable locking lever 430 is provided, and a connector 421 is fixed so as to slightly protrude from an aperture 411 (cf. FIG. 9) of the pocket at the rear face of the carriage 400. The locking lever 430 constitutes an operating portion of the carriage 400, functioning as a lever to be used by the operator for extracting the head cartridge 900 from the carriage 400. The connector 421 is electrically connected with the carriage circuit board 420 at the rear side of the carriage 400.

Figure 8:
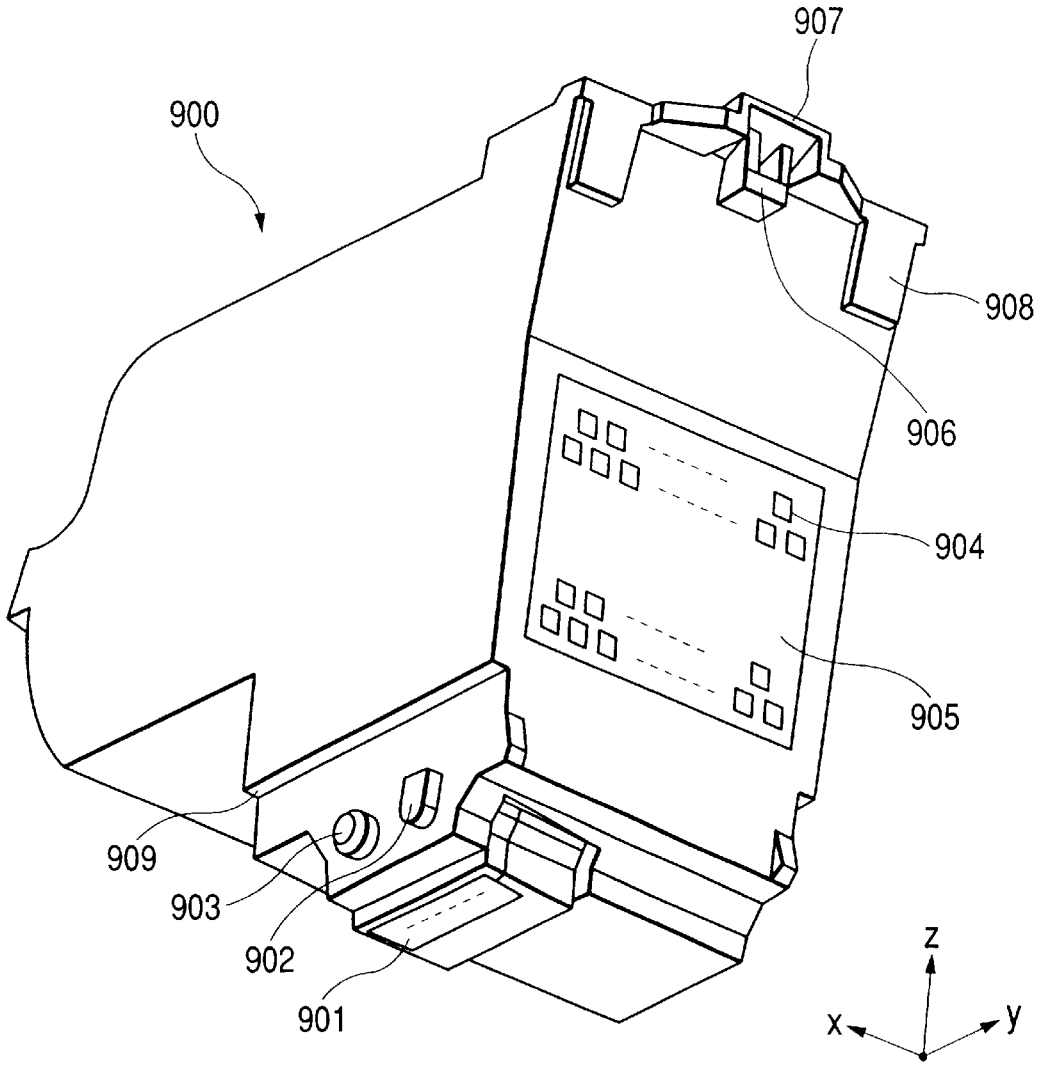
FIG. 8 is a perspective view showing the detailed structure of the head cartridge shown in FIG. 7.

On the other hand, the head cartridge 900 to be mounted on the carriage 400 is provided, as shown in FIG. 8, with a nozzle portion 901 as the ink discharging portion on the lower face, also with positioning projections 902 on both faces, with an impinging portion 903 in the x-direction on a lateral face, and an electric distribution plate 905 bearing plural contact pads 904 on the rear face. It is further provided, in the upper part of the rear face, with an impinging portion 906 in the y-direction, and inclined face 907 for receiving the pressing force of the locking lever 430, and a sliding portion 908 composed of an inclined face to be contacted in sliding motion by a push-out member 406 integrally formed with the locking lever 430, in order to shift the head cartridge 900 upwardly.

In the following there will be explained the attaching/detaching operation of the head cartridge 900, with reference to FIGS. 9 to 11, which are cross-sectional views of the carriage for explaining the attaching/detaching operation of the head cartridge 900.

Figure 9:
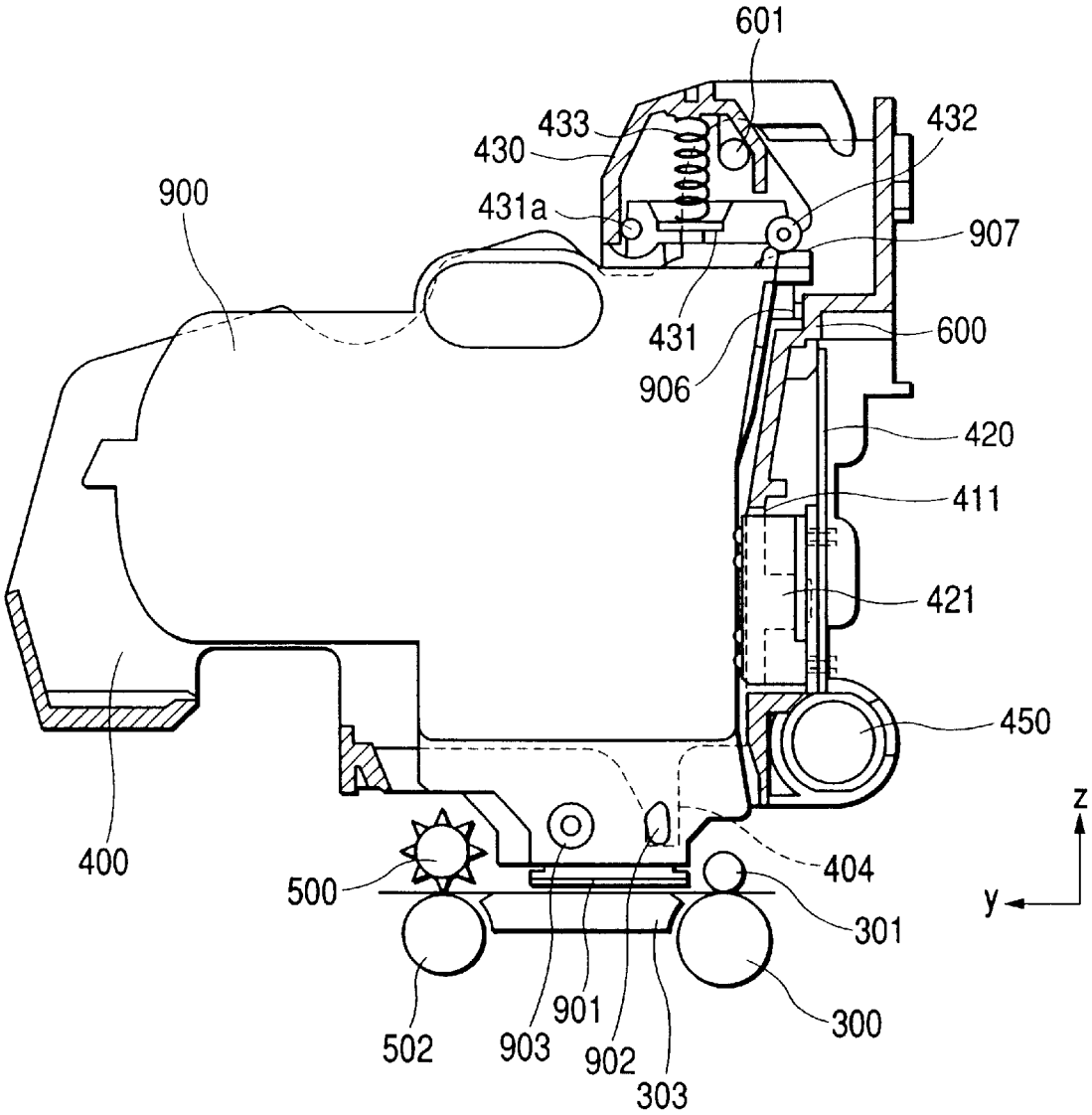
FIGS. 9, 10 and 11 are cross-sectional views of the carriage showing the attach/detaching operation of the head cartridge in the carriage shown in FIGS. 3A to 3C.

FIG. 9 shows a state of the head cartridge 900 locked in a predetermined position, wherein the positioning projection 902 thereof engages with a positioning groove 404 of the carriage 400 while the y-direction impinging portion 906 at the upper part of the rear face of the head cartridge is in pressure contact with a receiving face 600 of the carriage 400. In such state, the connector 421 is in contact, with an appropriate contact pressure, with the contact pads 904 thereby making electrical connection. This contact pressure functions not only to form the electrical connection but also to securely press the positioning projection 902 toward the positioning groove 404 and also to separate the impinging portion 906 from the receiving face 600. In a state where the y-direction impinging portion 906 and the receiving face 600 are separated, the position of the head cartridge 900 is unstable, so that the nozzle portion 901 has a low positional accuracy and the electrical connection also becomes unstable. It is therefore necessary to press the inclined face of the head cartridge 900 with a force larger than the contact pressure of the connector 421.

The locking lever 430 is rotatable about the supporting shaft 601 and is combined with a rocking arm 431, rocking about a fulcrum 431*a*, a pressure roller 432 mounted on the rocking arm 431, and a pressure spring 433 for biasing the rocking arm 431. In a pressing unit composed of these components, the pressure roller 432 presses the inclined face 907 of the head cartridge 900 to achieve secure impingement of the y-direction impinging portion 906 and the receiving face 600 and to achieve an impingement in the z-direction of the positioning projection 902 and the positioning groove 404.

Thus the position in the y-direction is determined by three points, namely by the positioning projections 902 (on both side faces) and the y-direction impinging portion 906, while the position in the z-direction is determined by two points, namely by the positioning projections 902 (on both side faces), and the position in the x-direction is determined by one point, namely the x-direction impinging portion 903, whereby the position of the head cartridge 900 becomes stabilized.

In such state, in the vicinity of the nozzle portion 901, there are positioned the pinch roller 301 in contact with the conveying roller 300 and the spur wheels 500 in contact with a sheet discharge roller 502. As the carriage 400 executes reciprocating motion along the guide shaft 450, the head cartridge 900 is naturally so positioned as not to interfere with any of these components in the locked state in the predetermined position, but it is preferable that the head cartridge 900 does not cause such interference also in the attaching or detaching operation thereof.

Figure 10:
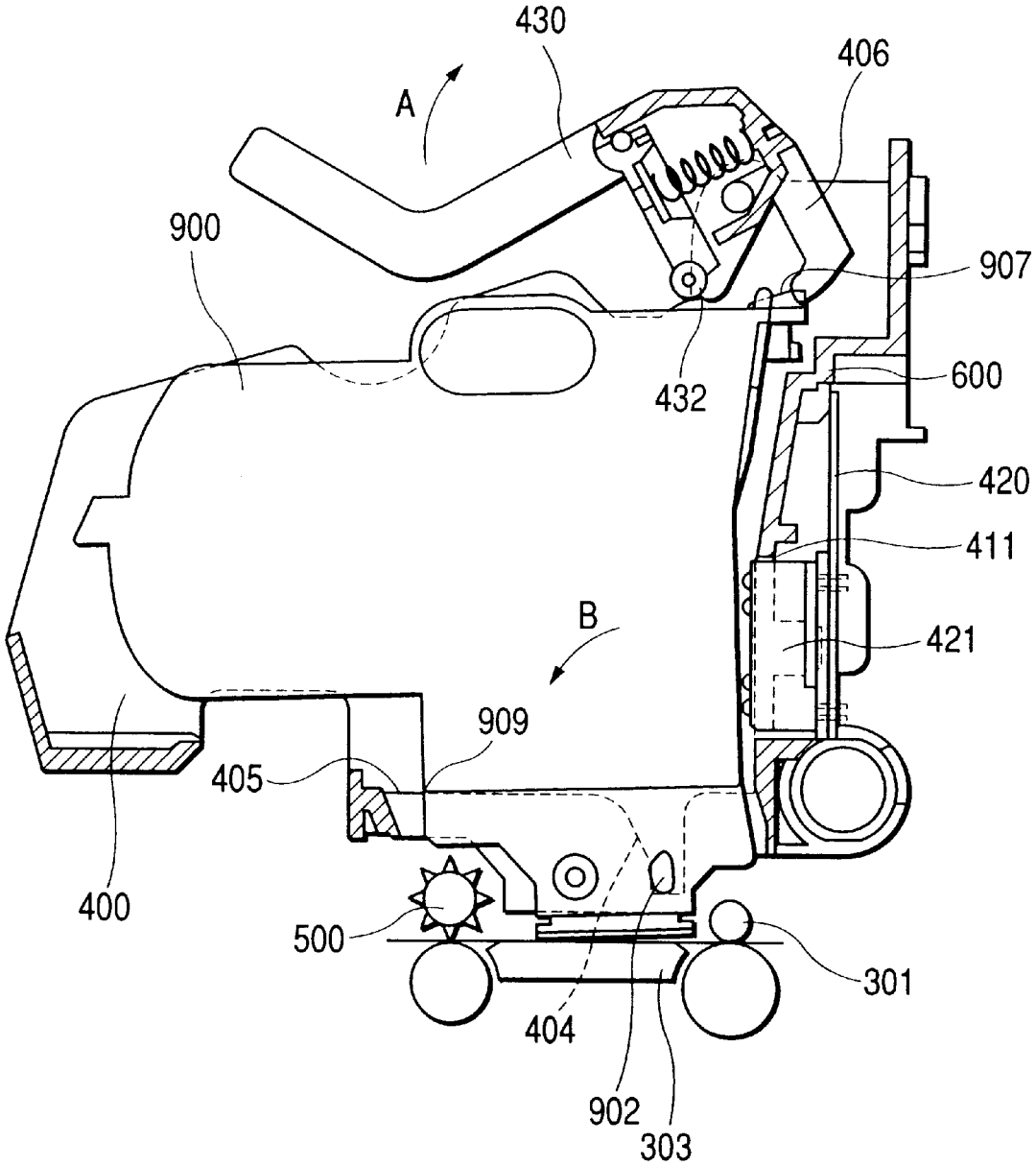

In the present embodiment, in extracting the head cartridge 900, the locking lever 430 is lifted in a direction A as shown in FIG. 10 whereby the pressure roller 432 is disengaged from the inclined face 907. Thus, by the repulsive force of the connector 421 and by the weight of the head cartridge 900, the head cartridge 900 rotates in a direction B about the positioning projections 902 on both sides. Such rotation, if continued, will result in interference with the platen 303, or the spur wheels 500, but, in the present embodiment, such interference can be avoided since the rotation is limited by the engagement of an auxiliary engaging portion 909 of the head cartridge 900 with an auxiliary guide 405 of the carriage 400.

When the locking lever 430 is rotated further, the push-out member 406 formed integrally with the locking lever 430 engages with the sliding portion 908 of the head cartridge 900, thereby pushing out the head cartridge 900 along the positioning grooves 404 and the auxiliary guides 405 of the carriage 400. Also in this operation, the head cartridge 900 moves along such a trajectory as not to cause interference with the platen 303 or the spur wheels 500.

Figure 11:
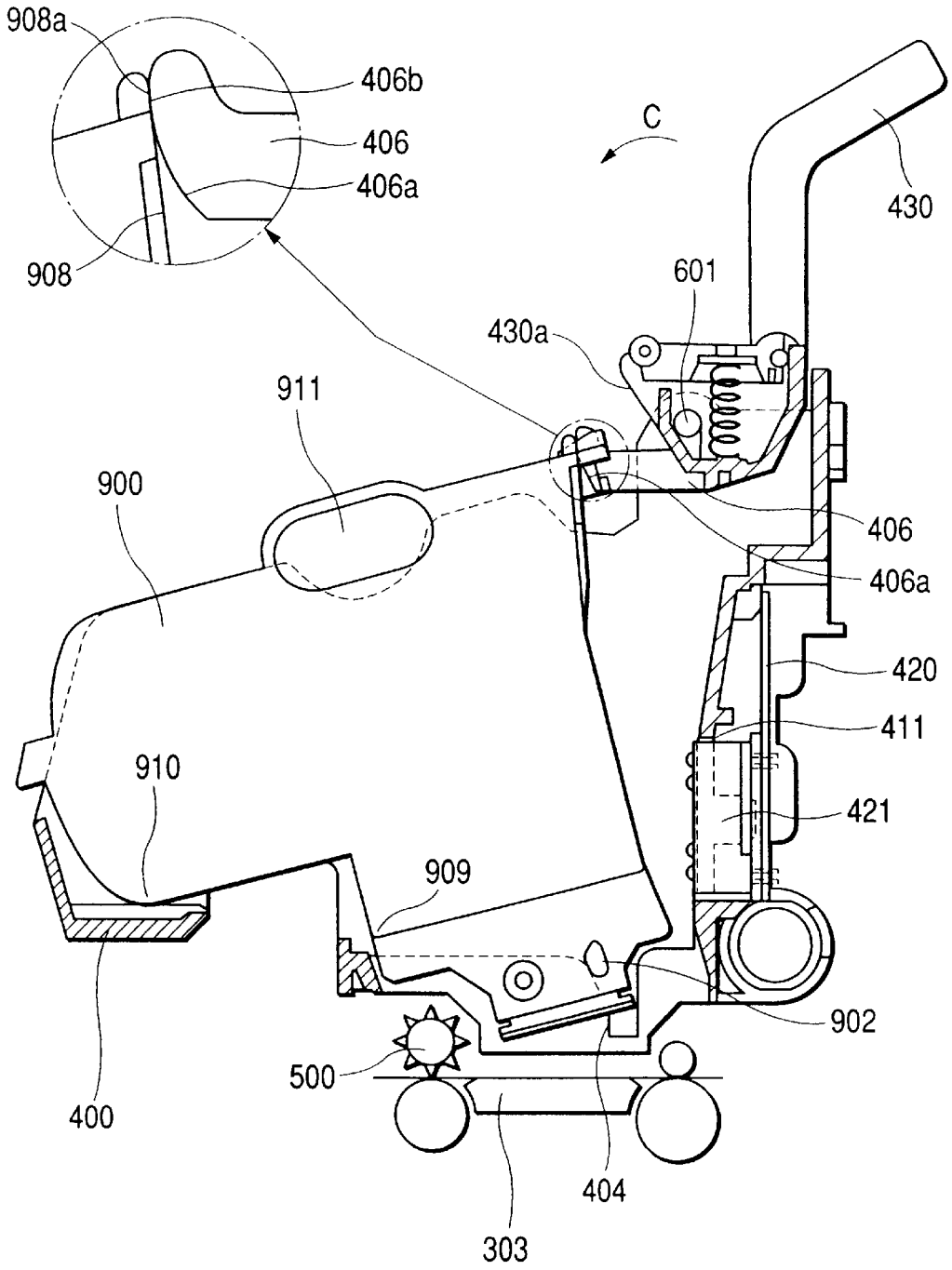

The head cartridge 900 may be simply pushed out to an easily extractable position by continuation of the rotation of the locking lever 430 to an appropriate position, but, in the present embodiment, the head cartridge 900 assumes a posture as shown in FIG. 11 in the exchange position.

More specifically, when the locking lever 430 is rotated to the end point, the head cartridge 900 is stably supported by another auxiliary engaging portion 910, the positioning projections 902 and the sliding portion 908. The shift is made from the auxiliary engaging portion 909 to the other auxiliary engaging portion 910 in order to stabilize the balance of the center of gravity, and an arc portion 406*a* of the push-out member 406 is formed concentrically with a shaft 601 in order to prevent reverse rotation of the locking lever 430 in a direction C by the weight of the head cartridge 900. Besides, when the locking lever 430 is rotated to the end point, the final engaging face 406*b* of the push-out member 406 and the engaging face 908*a* of the sliding portion 908 engage in a plane, whereby the head cartridge 900 does not return to the original position but is fixed in a state inclined toward the operator.

In this state, the operator can easily replace the cartridge by holding a grab portion (operating portion) 911 of the head cartridge 900.

In setting the head cartridge 900 again after the replacement thereof, the locking lever 430 is rotated in a direction C, whereby the head cartridge 900 changes its posture along the rotation of the push-out member 406. This is achieved by the positioning of the head cartridge 900, but, even if it is stopped on the way for example by frictional resistance, it is forcedly pushed in by a cam portion 430*a* of the locking lever 430 to a state shown in FIG. 10, and the setting is finally completed as shown in FIG. 9.

Figure 12:
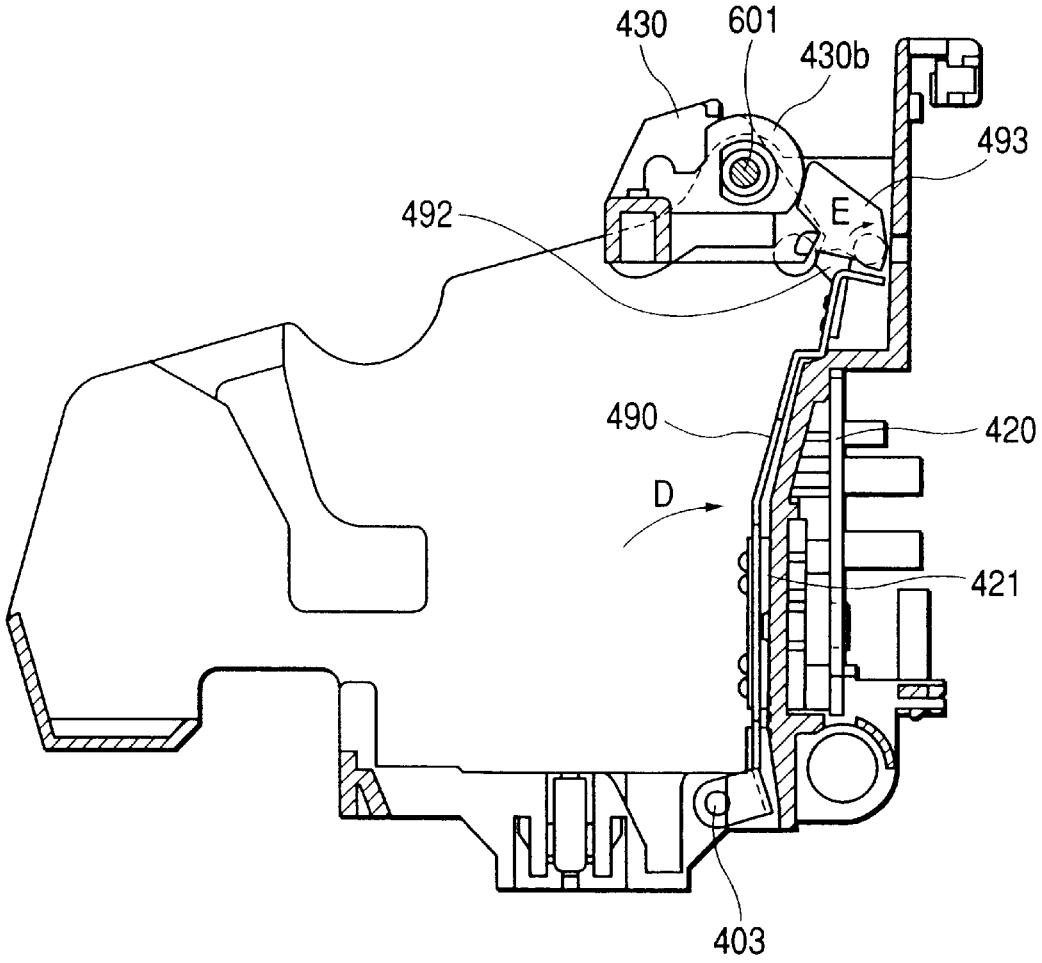
FIGS. 12 and 13 are cross-sectional views of the carriage showing the function of a connector protecting plate contained in the carriage shown in FIGS. 3A to 3C.
Figure 13:
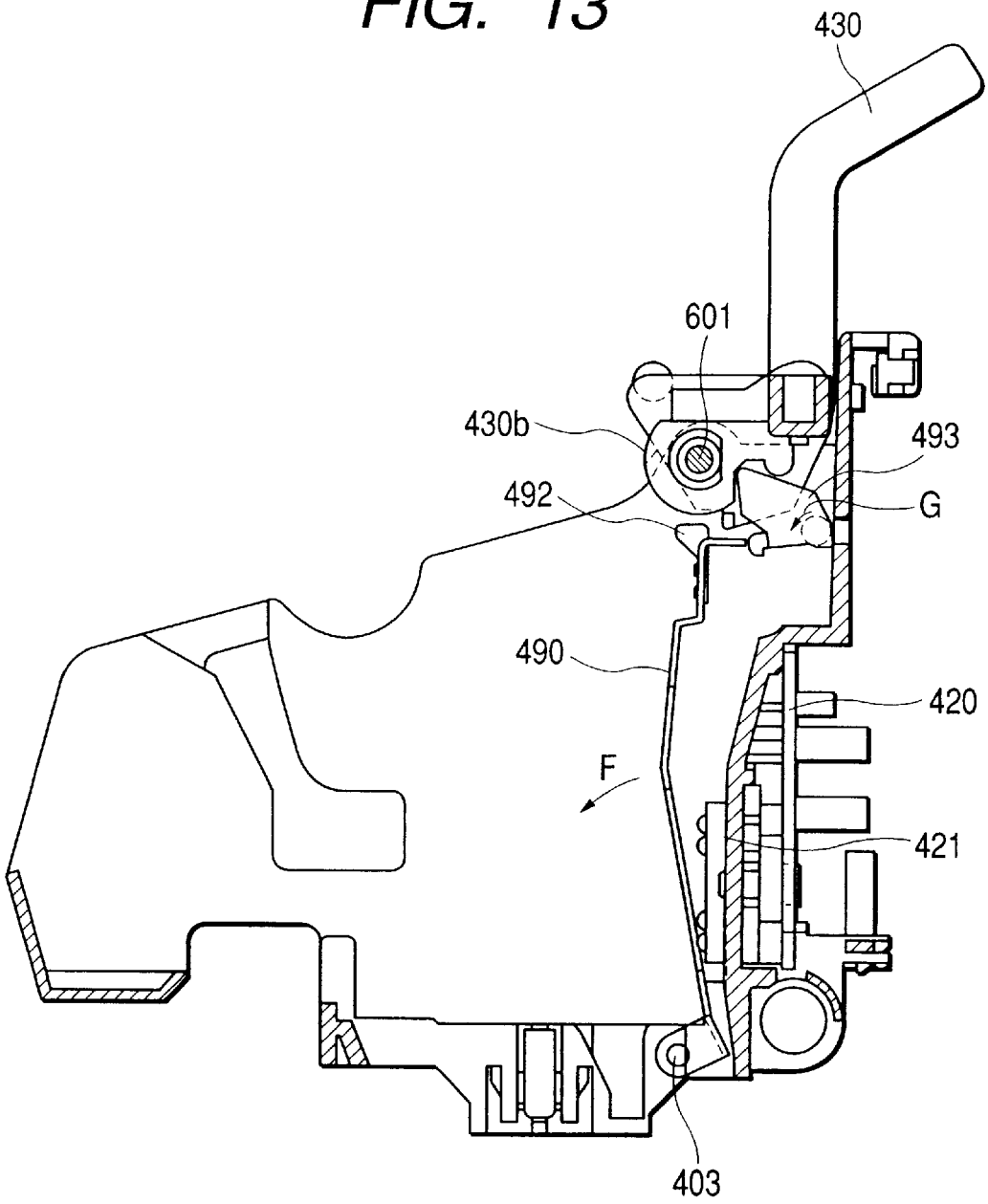

In the following there will be given a detailed explanation, with reference to FIGS. 12 and 13, on a connector protecting plate 490 featuring the present invention. FIGS. 12 and 13 are cross-sectional views of the carriage, respectively when the locking lever 430 is closed or opened. For the purpose of simplicity, the head cartridge 900 is omitted from these drawings.

Figure 4:
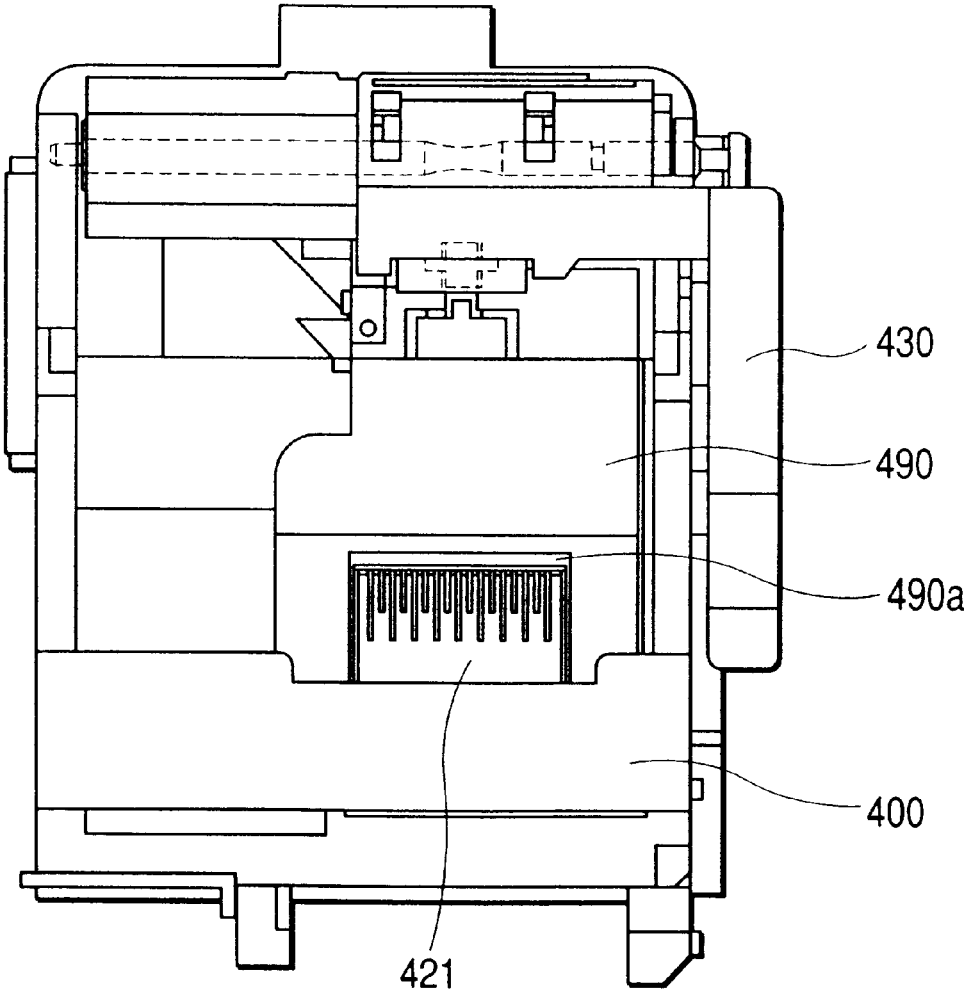
FIG. 4 is a front view of the carriage shown in FIG. 1.
Figure 5:
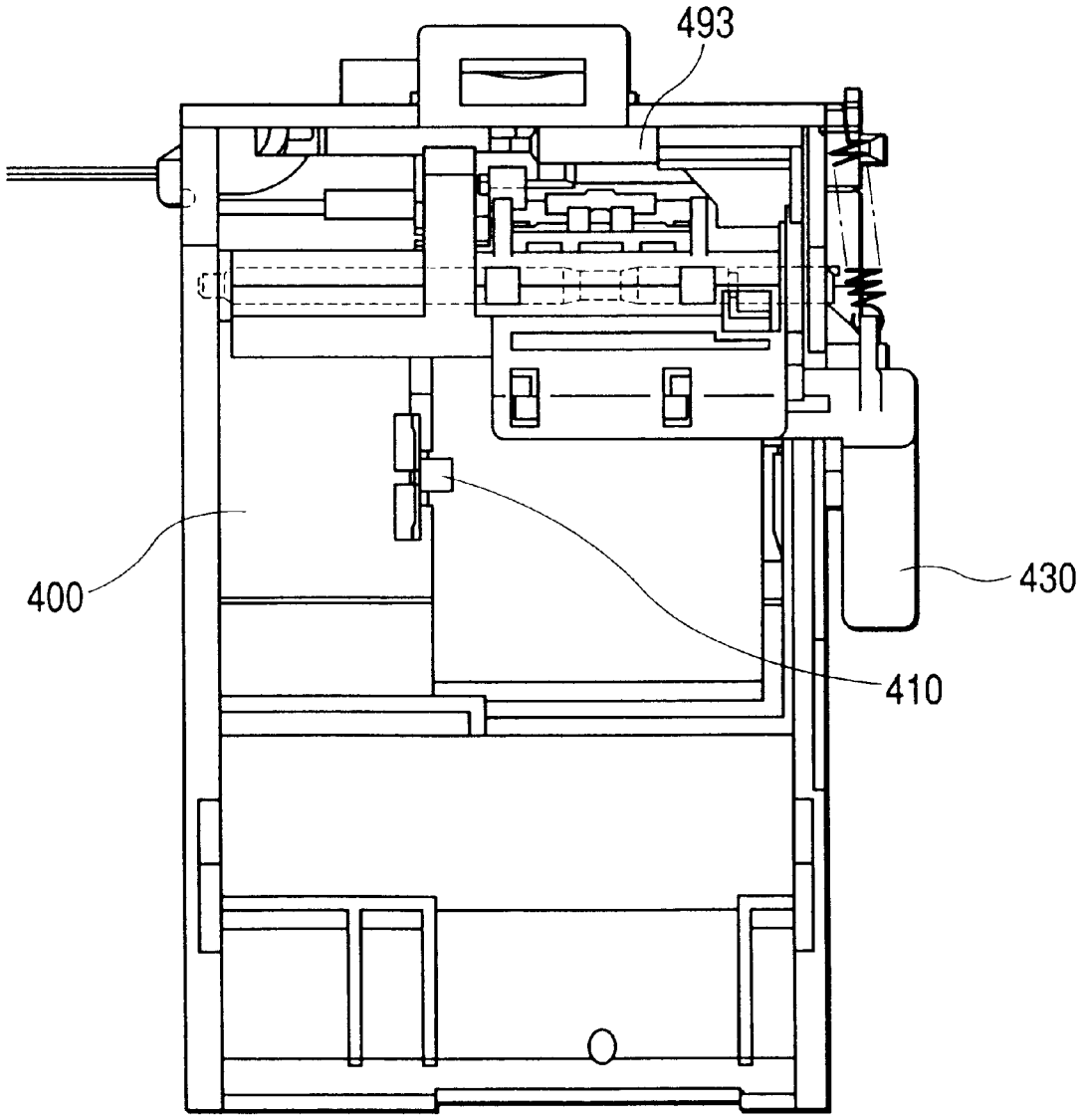
FIG. 5 is a plan view of the carriage shown in FIG. 1.
Figure 7:
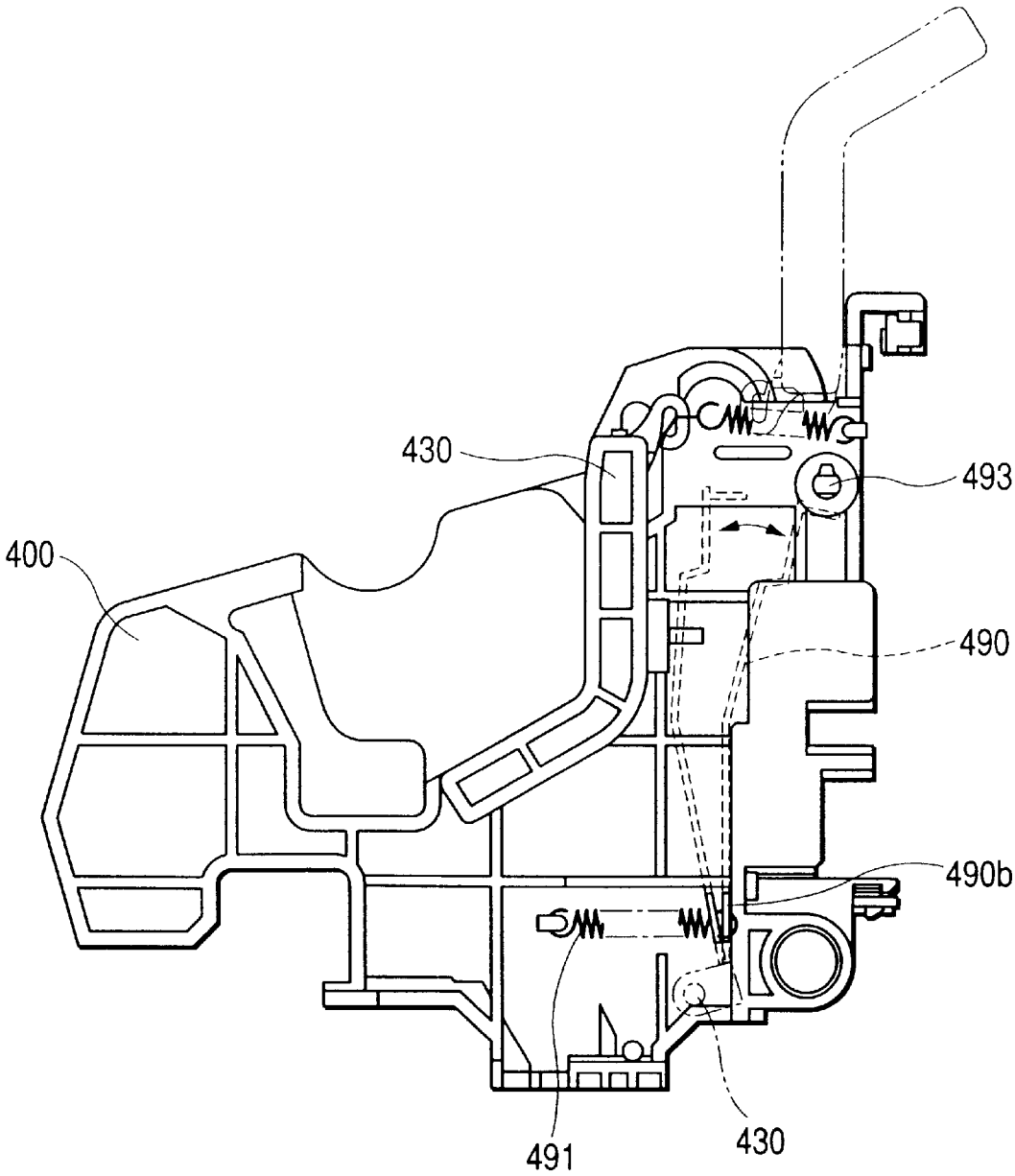
FIG. 7 is a right-side view of the carriage shown in FIG. 1.

A connector protecting plate 490 is a metal plate member for example of zinc-coated steel plate, and is fitted on and rendered rotatable about a boss 403 formed on the carriage 400. The connector protecting plate 490 is provided with an aperture 490*a* in a portion corresponding to the connector 421 of the carriage 400, when seen from the front as shown in FIG. 4. Also as shown in FIG. 7, a spring hook 490*b* protrudes from a hole formed on the right-side face of the carriage 400 and supports a protecting plate spring 491, whereby the connector protecting plate 490 is pulled to the front. A protecting plate release member 492 is composed for example of a plastic material and is fixed to the connector protecting plate 490 in such a manner that, when the locking lever 430 is closed as shown in FIG. 12, the protecting plate release member 492 comes into contact with the locking lever 430 whereby the connector protecting plate 490 is separated from the head cartridge 900. Thus the connector 421 passes through the aperture 490*a* of the connector protecting plate 490. Therefore the connector protecting plate 490 does not hinder the electrical contact between the contact pads 904 of the head cartridge 900 and the connector 421. A protecting plate latch 493 is fixed to and is rendered rotatable about a hole of the carriage 400. The protecting plate latch 493 is driven by a cam portion 430*b* of the locking lever 430 and limits the function of the connector protecting plate 490.

In the following there will be explained the function of the connector protecting plate 490. FIG. 12 shows a state when the locking lever 430 is closed. The protecting plate release member 492 fixed to the connector protecting plate 490 comes into contact with the locking member 430, thereby pushing the connector protecting plate 490 in a direction D. The connector protecting plate 490, being provided with an aperture 490*a,* is pushed to a position sufficiently retracted from the connector 421, and does not influence at all the electrical connection between the head cartridge 900 and the connector 421. Also the arc portion 406*a* (cf. FIG. 11) of the locking lever 430, coming into contact with the protecting plate release member 492, is concentric with the shaft 601, and does not exert a force in a direction to open the locking lever 430. The protecting plate latch 493 fixed to the carriage 400 is stopped in a position rotated in a direction E, by a cam portion 430*b* of the locking lever 430.

Now there will be explained a state where the locking lever 430 is opened as shown in FIG. 13. As the protecting plate release member 492 is released from the cam portion 430*b* of the locking lever 430, the connector protecting plate 490 is pulled in a direction F by the protecting plate spring 491 and is stopped in a state impinging on the inclined face of the hole provided on the right-hand face of the carriage 400 as shown in FIG. 7. In such position, the connector protecting plate 490 is sufficiently in front of the connector 421, whereby the connector 421 is protected by the connector protecting plate 490. The protecting plate latch 493 is guided by the cam portion 430*b* of the locking lever 430 and is stopped in a position rotated in a direction G.

In the case the operator mounts the head cartridge 900 on the carriage 400 in such state, the connector protecting plate 490 serves as a guide for the head cartridge 900. Also, as the connector 421 is protected by the connector protecting plate 490, it is protected from ink deposition from the nozzle portion 901 of the head carriage 900. Even if the connector protecting plate 490 is pushed by the head cartridge 900, there will not be a problem since it is limited by the protecting plate latch 493 so as to remain within a certain range. Even in the pushed state, the connector protecting plate 490 is naturally positioned in front of the connector 421. In the mounting on the carriage 400, the black head with a smaller width tends to be mounted in an inclined posture, but the connector 421 can be protected from the ink deposition from the nozzle portion of such black head. Also in case of mounting a head cartridge of a smaller size on the carriage 400, the connector 421 can be similarly protected from the ink deposition from the nozzles of such head cartridge.

[Second Embodiment]

Figure 14A:
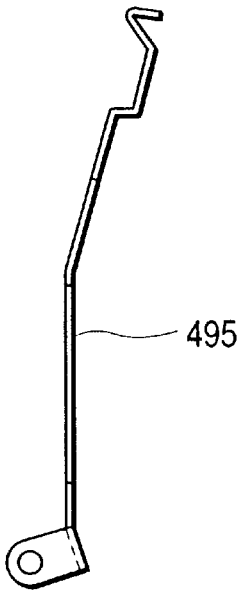
FIGS. 14A and 14B are side views of the connector protecting plate in a second embodiment of the present invention.
Figure 14B:
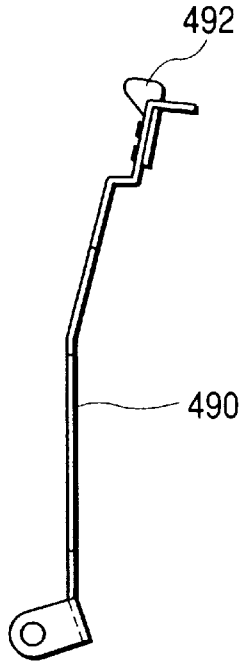

FIG. 14A shows the connector protecting plate in a second embodiment of the present invention, while FIG. 14B shows that of the first embodiment, for the purpose of comparison.

In the foregoing first embodiment, the connector protecting plate 490 is formed by a metal plate such as zinc-coated steel plate while the protecting plate release member 492 is formed for example by a plastic material and both members are thereafter assembled and fixed together. In the second embodiment, a connector protecting plate 495 has an integral form coming into contact with the arc portion of the locking lever 430.

Such integral form of the connector protecting plate 495, including the form of the protecting plate release member 492, allows to reduce the number of the parts thereby reducing the assembling cost.

Other configurations are same as those in the first embodiment.

[Other Embodiments]

The foregoing embodiments have been explained by a printer in which an ink jet head cartridge is mounted on the carriage, but the configuration of the present invention can be also advantageously applied for example to an information processing apparatus provided with a scanner unit having an external shape substantially same as that of the ink jet cartridge and being mountable on the carriage compatibly with such ink jet cartridge, thereby reading the image information from an original sheet supported on the platen.

In attaching or detaching the scanner unit, there is no danger of ink deposition on the connector portion of the carriage, but the present invention avoids the danger of damaging the connector of the carriage by the contact of the scanner unit.

Also the present invention is not limited to the ink jet recording apparatus, but is likewise applicable to various recording apparatuses, for example, of the thermal-sensitive system or thermal transfer system.

Among various ink jet printing systems, the present invention brings about excellent effects particularly in an image forming apparatus utilizing a recording head of the ink jet recording system utilizing thermal energy for forming a flying liquid droplet thereby forming a record.

The representative configuration and principle are disclosed, for example, in U.S. Pat. Nos. 4,723,129 and 4,740,796, and the present invention is preferably achieved with such basic principle. This recording system is applicable to either of the so-called on-demand type and the continuous type.

In brief, this recording system consists of applying at least one driving signal, which causes rapid temperature elevation exceeding nucleate boiling and inducing a film boiling phenomenon, corresponding to the recording information to an electrothermal converting member arranged corresponding to a sheet or a liquid channel holding liquid (ink), thereby generating thermal energy at the electrothermal converting member to induce film boiling at the heat action surface of the printing head. Thus, a bubble can be formed in the liquid (ink) corresponding one-on-one to the driving signal, so that this system is particularly suitable for on-demand recording. By discharging the liquid (ink) through a discharge opening by the growth and shrinkage of the bubble, at least a droplet is formed. By forming the driving signals into pulse shapes, growth and shrinkage of the bubble can be effected instantly and adequately to accomplish more preferable discharging of the liquid (ink) particularly excellent in the response characteristics. As the driving signals of such pulse shapes, those disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat action surface.

As the configuration of the printing head, in addition to the combinations of the discharging orifice, liquid channel and electrothermal converting member (linear liquid channel or right-angled liquid channel) as disclosed in the above-mentioned respective specifications, the configuration by the use of U.S. Pat. Nos. 4,558,333 and 4,459,600 disclosing the configuration having the heat action portion arranged in the flexed region is also included in the present invention.

In addition, the present invention can be effectively applied to the configuration of Japanese Patent Laid-Open Application No. 59-123670 using a slit common to a plurality of electrothermal converting members as the discharging portion of the electrothermal converting members or of Japanese Patent Laid-Open Application No. 59-138461 having the opening for absorbing a pressure wave of thermal energy corresponding to the discharging portion.

Also in the configuration of the recording apparatus of the present invention, the addition of discharge restoration means for the recording head, preliminary auxiliary means, etc., is preferable, because the effect of the present invention can be further stabilized. Specific examples of these may include capping means, cleaning means, pressurization or suction means, preliminary heating means for effecting heating by an electrothermal converting member, another heating element or a combination thereof, and preliminary discharge means for effecting an idle discharge independent of that for printing.

Furthermore, the recording head the present invention is applicable not only to liquid ink, but also to ink which is solid below room temperature but softens or liquefies at room temperature, or which softens or liquefies within a temperature control range from 30° C. to 70° C., which is ordinarily adopted in the ink jet recording. Thus, the ink only needs to be liquid when the recording signal is applied.

Besides the recording head of the present invention can employ ink liquefied by thermal energy provided corresponding to the recording signal, such as the ink in which the temperature elevation by thermal energy is intentionally absorbed by the state change from solid to liquid, or the ink which remains solid in the unused state for the purpose of prevention of ink evaporation. Thus, the present invention is also applicable to the case of liquefying the ink by the thermal energy provided corresponding to the recording signal and discharging the thus liquefied ink, or the case of using ink which starts to solidify upon reaching the recording medium.

In these cases the ink may be supported as solid or liquid in recesses or holes of a porous sheet, as described in Japanese Patent Laid-Open Application Nos. 54-56847 and 60-71260, and placed in an opposed state to the electrothermal converting member.

Furthermore, the ink jet recording apparatus of the present invention may assume the form an image output terminal for an information processing equipment such as a computer, a copying apparatus combined with a reader or the like, or a facsimile apparatus having transmitting and receiving functions.

As explained in the foregoing, the embodiments comprise a connector protecting member for protecting the connector to be electrically connected with the head cartridge, which is to be mounted on the carriage of the ink jet recording apparatus, thereby preventing ink deposition from the ink discharging portion onto the connector at the attaching or detaching of the head cartridge and avoiding the shortcircuiting in the connector resulting in the defective recording or the malfunction of the apparatus.

What is claimed is:

1. A carriage for a recording apparatus, comprising:

a head mounting portion on which a head cartridge is detachably mounted;

a connector portion, fixed on said head mounting portion, to be electrically connected with said head cartridge;

an operating portion for rendering said head cartridge attachable to or detachable from said head mounting portion, wherein when rotated in a forward direction, said operating portion fixes said head cartridge mounted on said head mounting portion and electrically connects said connector portion, while when rotated in a reverse direction, said operating portion releases the electrical connection between said head cartridge and said connector portion; and a connector protecting member adapted to protect said connector portion and being linked with the rotation of said operating portion, wherein when said operating portion is rotated in the forward direction, said connector protecting member moves to a position exposing said connector portion, while when said operating portion is rotated in the reverse direction, said connector protecting member moves to a position protecting said connector portion and concurrently serves as a guide in attaching or detaching said head cartridge.

2. A carriage according to claim 1, wherein said connector protecting member serves to prevent contact between a recording portion of said head cartridge and said connector portion, at the attaching or detaching of said head cartridge to or from said head mounting portion.

3. A carriage according to claim 1, wherein said connector protecting member is rotatable about a boss provided on said head mounting portion.

4. A carriage according to claim 1, further comprising a latch member linked with the rotation of said operating portion, wherein when said operating portion is rotated in the reverse direction, said latch member limits the movement of said connector protecting member, while when said operating portion is rotated in the forward direction, said latch member releases the limitation on the movement of said connector protecting member.

5. A carriage according to claim 1, further comprising a release portion formed integrally with or as a separate member from said connector protecting member, wherein said release portion contacts with said operating portion to separate said connector protecting member from said head cartridge when said operating portion is rotated in the forward direction.

6. A carriage for a recording apparatus for mounting plural head cartridges of different sizes, comprising:

a head mounting portion on which a head cartridge is detachably mounted;

a connector portion, fixed on said head mounting portion, to be electrically connected with said head cartridge;

an operating portion for rendering said head cartridge attachable to or detachable from said head mounting portion, wherein when rotated in a forward direction, said operating portion fixes said head cartridge mounted on said head mounting portion and electrically connects said connector portion, while when rotated in a reverse direction, said operating portion releases the electrical connection between said head cartridge and said connector portion; and a connector protecting member adapted to protect said connector portion and being linked with the rotation of said operating portion, wherein when said operating portion is rotated in the forward direction, said connector protecting member moves to a position exposing said connector portion, while when said operating portion is rotated in the reverse direction, said connector protecting member moves to a position protecting said connector portion and concurrently serves as a guide in attaching or detaching said head cartridge.

7. A carriage according to claim 6, wherein said connector protecting member serves to prevent contact between a recording portion of said head cartridge and said connector portion, at the attaching or detaching of said head cartridge to or from said head mounting portion.

8. A carriage according to claim 6, wherein said connector protecting member is rotatable about a boss provided on said head mounting portion.

9. A carriage according to claim 6, further comprising a latch member linked with the rotation of said operating portion, wherein when said operating portion is rotated in the reverse direction, said latch member limits the movement of said connector protecting member, while when said operating portion is rotated in the forward direction, said latch member releases the limitation on the movement of said connector protecting member.

10. A carriage according to claim 6, further comprising a release portion formed integrally with or as a separate member from said connector protecting member, wherein said release portion contacts with said operating portion to separate said connector protecting member from said head cartridge when said operating portion is rotated in the forward direction.

11. A recording apparatus, comprising:

a head mounting portion on which a head cartridge is detachably mounted;

a connector portion, fixed on said head mounting portion, to be electrically connected with said head cartridge;

an operating portion for rendering said head cartridge attachable to or detachable from said head mounting portion, wherein when rotated in a forward direction, said operating portion fixes said head cartridge mounted on said head mounting portion and electrically connects said connector portion, while when rotated in a reverse direction, said operating portion releases the electrical connection between said head cartridge and said connector portion;

a connector protecting member adapted to protect said connector portion and being linked with the rotation of said operating portion, wherein when said operating portion is rotated in the forward direction, said connector protecting member moves to a position exposing said connector portion, while when said operating portion is rotated in the reverse direction, said connector protecting member moves to a position protecting said connector portion and concurrently serves as a guide in attaching or detaching said head cartridge; and conveying means for conveying a sheet material to be subjected to recording by said head cartridge.

12. A recording apparatus according to claim 11, wherein said head cartridge is an ink jet recording head capable of recording an image by discharging ink.

13. A recording apparatus according to claim 12, wherein said ink jet recording head records the image with ink liquid droplets formed by thermal energy.

14. A recording apparatus according to claim 11, wherein said connector protecting member serves to prevent contact between a recording portion of said head cartridge and said connector portion, at the attaching or detaching of said head cartridge to or from said head mounting portion.

15. A recording apparatus according to claim 11, wherein said connector protecting member is rotatable about a boss provided on said head mounting portion.

16. A recording apparatus according to claim 11, further comprising a latch member linked with the rotation of said operating portion, wherein when said operating portion is rotated in the reverse direction, said latch member limits the movement of said connector protecting member, while when said operating portion is rotated in the reverse direction, said latch member releases the limitation on the movement of said connector protecting member.

17. A recording apparatus according to claim 11, further comprising a release portion formed integrally with or as a separate member from said connector protecting member, wherein said release portion contacts with said operating portion to separate said connector protecting member from said head cartridge when said operating portion is rotated in the forward direction.

18. A recording apparatus, comprising:

a carriage detachably supporting a head cartridge including cartridge positioning portions on both sides and an inclined face in the upper part of a rear face thereof, said carriage including a fixed connector portion to be electrically connected with said head cartridge, carriage positioning portions for engaging with the cartridge positioning portions on both sides of said head cartridge, and an operating portion rendered rotatable adjacent the upper part of said head cartridge and adapted, when rotated in a forward direction, to press said inclined face thereby fixing said head cartridge in said carriage;

a connector protecting member adapted to protect said connector portion and being linked with the rotation of said operating portion, wherein when said operating portion is rotated in the forward direction rendering said head cartridge detachable or mountable, said connector protecting member moves to a position exposing said connector portion, while when said operating portion is rotated in a reverse direction fixing said head cartridge, said connector protecting member moves to a position protecting said connector portion and concurrently serves as a guide in attaching or detaching said head cartridge; and conveying means for conveying a sheet material to be subjected to recording by said head cartridge.

19. A recording apparatus according to claim 18, wherein said head cartridge is an ink jet recording head capable of recording an image by discharging ink.

20. A recording apparatus according to claim 19, wherein said ink jet recording head records the image with ink liquid droplets formed by thermal energy.

21. A recording apparatus according to claim 18, wherein said connector protecting member serves to prevent contact between a recording portion of said head cartridge and said connector portion, at the attaching or detaching of said head cartridge to or from said carriage.

22. A recording apparatus according to claim 18, wherein said connector protecting member is rotatable about a boss provided on said carriage.

23. A recording apparatus according to claim 18, further comprising a latch member linked with the rotation of said operating portion, wherein when said operating portion is rotated in the reverse direction, said latch member limits the movement of said connector protecting member, while when said operating portion is rotated in the forward direction, said latch member releases the limitation on the movement of said connector protecting member.

24. A recording apparatus according to claim 18, further comprising a release portion formed integrally with or as a separate member from said connector protecting member, wherein said release portion contacts with said operating portion to separate said connector protecting member from said head cartridge when said operating portion is rotated in the forward direction.

* * * * *

UNITED STATES PATENT AND TRADEMARK OFFICE

CERTIFICATE OF CORRECTION

PATENT NO. : 6,520,625 B1
DATED : February 18, 2003
INVENTOR(S) : Kawakami

It is certified that error appears in the above-identified patent and that said Letters Patent is hereby corrected as shown below:

Column 4,
Line 3, “comer” should read -- corner --.
Line 4, “materials thereby” should read -- materials, thereby --.
Line 57, “inkjet” should read -- ink jet --.

Column 6,
Line 22, “images.” should read -- image. --.
Line 37, “leaning” should read -- cleaning --.

Signed and Sealed this

Eleventh Day of November, 2003

JAMES E. ROGAN
*Director of the United States Patent and Trademark Office*